US011268391B2

(12) United States Patent
Kislinger

(10) Patent No.: US 11,268,391 B2
(45) Date of Patent: Mar. 8, 2022

(54) STATOR VANE SEGMENT FOR A TURBOMACHINE

(71) Applicant: MTU Aero Engines AG, Munich (DE)

(72) Inventor: Bernd Kislinger, Reisgang (DE)

(73) Assignee: MTU Aero Engine AG, Munich (DE)

( * ) Notice: Subject to any disclaimer, the term of this patent is extended or adjusted under 35 U.S.C. 154(b) by 546 days.

(21) Appl. No.: 16/045,867

(22) Filed: Jul. 26, 2018

(65) Prior Publication Data

US 2019/0040754 A1 Feb. 7, 2019

(30) Foreign Application Priority Data

Aug. 4, 2017 (EP) ..... 17184855

(51) Int. Cl.
*F01D 9/04* (2006.01)
*F01D 25/24* (2006.01)
(Continued)

(52) U.S. Cl.
CPC ..... *F01D 9/041* (2013.01); *F01D 5/14* (2013.01); *F01D 9/04* (2013.01); *F01D 9/047* (2013.01);
(Continued)

(58) Field of Classification Search
CPC . F01D 9/041; F01D 9/04; F01D 9/047; F01D 25/246; F01D 11/005; F01D 5/14; F01D 11/00; F05D 2260/941; F05D 2240/128; F05D 2230/21; F05D 2250/75; F05D 2250/71; F05D 2230/10
See application file for complete search history.

(56) References Cited

U.S. PATENT DOCUMENTS 3,860,358 A * 1/1975 Cavicchi ..... F01D 11/08 415/173.1
5,071,313 A * 12/1991 Nichols ..... F01D 25/246 415/134

(Continued)

FOREIGN PATENT DOCUMENTS

FR 3 024 884 A1 2/2016
GB 2 471 185 12/2010

*Primary Examiner* — Kenneth Bomberg
*Assistant Examiner* — Adam W Brown
(74) *Attorney, Agent, or Firm* — Davidson, Davidson & Kappel, LLC

(57) ABSTRACT

A stator vane segment for a turbomachine is provided, in particular for a gas turbine, in particular for a turbine stage of a gas turbine. The stator vane segment has at least one stator vane and at least one shroud, in particular an outer shroud, having at least one first profile disposed on the shroud and adapted for attachment of the stator vane segment to the turbomachine casing, the profile extending in the circumferential direction at least partially over a circumferential length of the stator vane segment along the shroud of the stator vane segment and having at least one functional surface which extends at least partially in the axial direction and in the circumferential direction, at least one functional surface of at least one profile having at least two different curvatures in the circumferential direction in at least one radial plane perpendicular to an axis of rotation of the turbomachine in at least one temperature range below a defined operating temperature of the turbomachine.

25 Claims, 6 Drawing Sheets

(51) Int. Cl.
*F01D 11/00* (2006.01)
*F01D 5/14* (2006.01)

(52) U.S. Cl.
CPC ..... *F01D 11/00* (2013.01); *F01D 11/005* (2013.01); *F01D 25/246* (2013.01); *F05D 2230/10* (2013.01); *F05D 2230/21* (2013.01); *F05D 2240/128* (2013.01); *F05D 2250/71* (2013.01); *F05D 2250/75* (2013.01); *F05D 2260/941* (2013.01)

(56) References Cited

U.S. PATENT DOCUMENTS 5,641,267 A * 6/1997 Proctor ..... F01D 11/08 415/173.1
7,438,520 B2 * 10/2008 Ruthemeyer ..... F01D 11/08 415/135
7,442,004 B2 * 10/2008 Ruthemeyer ..... F01D 9/04 415/135
7,448,846 B2 * 11/2008 Ruthemeyer ..... F01D 11/12 415/135
7,452,183 B2 * 11/2008 Ruthemeyer ..... F01D 11/005 415/135
7,458,772 B2 * 12/2008 Benedetti ..... F01D 9/042 415/173.1
8,096,755 B2 * 1/2012 Kammel ..... F01D 9/041 415/173.1
8,313,292 B2 * 11/2012 Glynn ..... F01D 9/041 415/210.1
9,074,490 B2 * 7/2015 Benkler ..... F01D 25/26
10,280,780 B2 * 5/2019 Bergman ..... F16J 15/022
2003/0133790 A1 * 7/2003 Darkins, Jr. ..... F01D 9/04 415/139
2007/0031245 A1 2/2007 Ruthmeyer et al.
2008/0152488 A1 * 6/2008 Kammel ..... F01D 9/041 415/209.4
2020/0149418 A1 * 5/2020 Whittle ..... F01D 5/225

* cited by examiner

Fig. 3
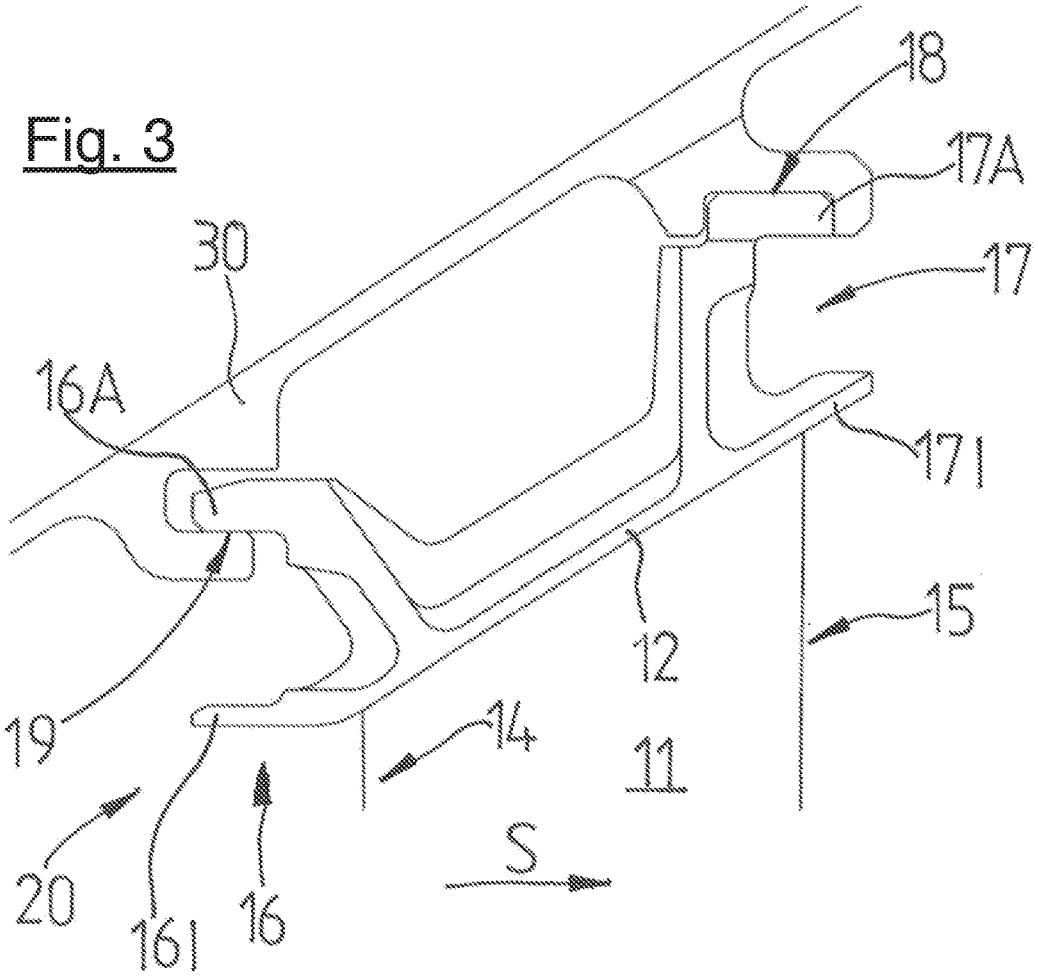
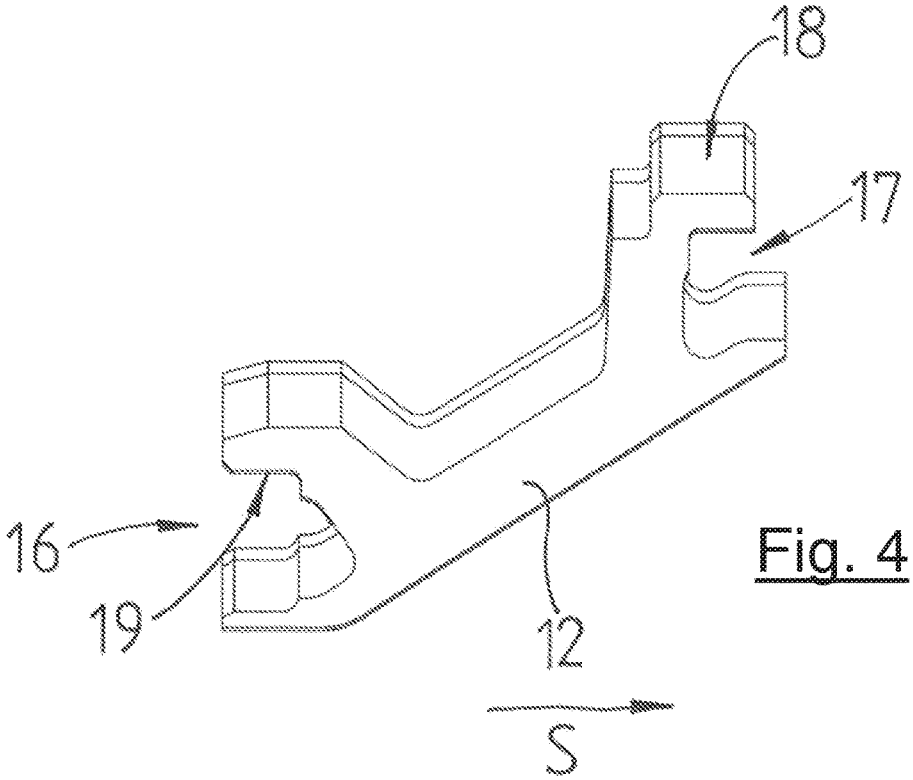
Fig. 4

STATOR VANE SEGMENT FOR A TURBOMACHINE

This claims the benefit of European Patent Application EP17184855.9, filed Aug. 4, 2017 and hereby incorporated by reference herein.

The present invention relates to a stator vane segment for a turbomachine, in particular for a gas turbine, in particular for a turbine stage of a gas turbine, to a stator vane array, in particular of a turbine stage, including the stator vane segment, and to a turbomachine, in particular a gas turbine, including the stator vane segment, as well as to a method for manufacturing the stator vane segment.

BACKGROUND

In the prior art, there are generally known stator vane segments for turbomachines, in particular for gas turbines, which stator vane segments have one or more profiles for mounting the stator vane segment in a turbomachine casing. Due to the high temperatures occurring during operation of the turbomachine, unwanted distortions and/or leakages may occur in the region of attachment of the stator vane segments to the turbomachine casing as a result of non-uniform thermal expansion of the stator vane segment during operation.

GB 2 471 185 describes that the contact surface of an upstream hook profile of a stator vane segment for a gas turbine and the contact surface of a downstream hook profile of the stator vane segment, which contact surfaces are adapted to bear against the turbine casing, may be configured such that, in an operating condition below a defined operating temperature, they each have different curvatures in the circumferential direction relative to an axis of rotation of the gas turbine, and that they each have a curvature different than that of the contact surface of the turbine casing in order to achieve full contact of each of the contact surfaces of the hook profiles of the stator vane segment with the turbine casing in the circumferential direction at the defined operating temperature.

SUMMARY OF THE INVENTION

It is an object of an embodiment of the present invention to improve a stator vane segment, in particular the mounting thereof in a turbomachine casing.

The present invention provides a stator vane segment, a stator vane array, a turbomachine, and a method. Advantageous embodiments of the present invention are the subject matter of the dependent claims.

In an embodiment of the present invention, a stator vane segment for a turbomachine, in particular for a gas turbine, in particular for a turbine stage of a gas turbine, includes one or more stator vanes and one or more shrouds, in particular at least an outer shroud having disposed thereon at least one profile which is also referred herein as first profile and serves for attachment of the stator vane segment to the turbomachine casing, the (first) profile extending in the circumferential direction at least partially over a circumferential length of the stator vane segment along the shroud of the stator vane segment and having at least one functional surface which extends at least partially in the axial direction and in the circumferential direction and serves, in particular, for attachment of the stator vane segment to the turbomachine casing, at least the functional surface of at least this (first) profile having at least two different curvatures in the circumferential direction in one or more radial planes perpendicular to an axis of rotation of the turbomachine in at least one temperature range below a defined operating temperature of the turbomachine.

Thus, in an embodiment of the present invention, the functional surface of at least one profile for attachment of the stator vane segment to the turbomachine casing is curved with at least two different curvatures in the circumferential direction of the stator vane segment, as considered in an installed operative condition in a turbomachine casing, in at least one temperature range below a defined operating temperature of the turbomachine, and at least two different circles of curvature exist in the circumferential direction for at least one functional surface of the profile in at least one radial plane relative to the axis of rotation of the turbomachine, the two circles of curvature differing in particular in their radius of curvature and/or in their center of curvature.

By incorporating at least two different curvatures into a functional surface of a profile for attachment of the stator vane segment to a turbomachine casing, a change in curvature caused by heating of the stator vane segment may at least partially be compensated for, provided the different curvatures of the functional surface are suitably configured, so that, in an embodiment, at least substantially full contact may be achieved at the turbomachine casing between the functional surface and an associated contact surface of the turbomachine casing, in particular one having a constant curvature, at least at the defined operating temperature.

Therefore, in an embodiment, improved support of the stator vane segment against the turbomachine casing may be achieved in the turbomachine casing. In an embodiment, additionally or alternatively, the sealing action against the turbomachine casing may be improved, which has a beneficial effect on the efficiency of turbomachine.

As is customary in the art, the directional term "axial" as used herein refers to a direction parallel to an axis of rotation or (main) machine axis of the turbomachine, the directional term "circumferential direction" correspondingly refers to a direction of rotation about this axis of rotation or (main) machine axis, and the directional term "radial" refers to a direction that is perpendicular to the axial direction and to the circumferential direction.

As is customary in the art, the term "radial plane" as used herein refers to a plane normal to an axis of rotation, in the present case in particular to a plane normal to the axis of rotation of the turbomachine; i.e., in particular to a plane oriented perpendicularly to the (main) machine axis.

As is customary in the art, a circle of curvature, in particular a circle of curvature belonging to a point of a curve, is understood herein to be a circle which has the tangent at a point of a curve $y=f(x)$; i.e., the first derivative $y'=f'(x)$ and the second derivative $y''=f''(x)$, in common with this point.

In an embodiment of the present invention, the at least one profile of the stator vane segment extends in the circumferential direction in particular entirely over the circumferential length of the shroud of the stator vane segment.

In an embodiment of the present invention, the functional surface of the profile extends in the circumferential direction in particular entirely over the full circumferential length of the profile.

In an embodiment of the present invention, the at least one profile disposed on the shroud is adapted for attachment of the stator vane segment to the turbomachine casing, in particular for supporting and/or sealing the stator vane segment against the turbomachine casing. In particular, at least one functional surface is, in particular at least partially, configured as a supporting surface via which forces acting upon the stator vane segment, in particular during operation of the turbomachine, can be supported against the turbomachine casing and/or is, in particular at least partially, configured as a sealing surface, in particular for sealing against the turbomachine casing, the sealing surface being configured in particular to match a contact surface on the turbomachine casing.

In an embodiment of the present invention, the at least one functional surface of the at least one profile extends in an at least partially axial direction; i.e., at least with a directional component in a direction parallel to the axis of rotation of the turbomachine, in one embodiment without curvature; i.e., it extends in particular linearly in this direction, or has a constant curvature over its width in an at least partially axial direction, or has also at least two different directions; i.e., or follows, in an at least partially axial direction, a curve having a varying radius of curvature.

As is customary in the art, the term "constant" as used in the context of the present invention means "uniform," but encompasses also deviations of up to ±10%, in particular deviations within normal tolerance ranges.

In an embodiment of the present invention, a stator vane segment in particular additionally has an inner shroud for attachment of the stator vane segment on the rotation axis side, in particular for attachment to a turbomachine casing on the rotation axis side.

In an embodiment of the present invention, the stator vane segment has at least one, or the, first, in particular upstream, in particular upstream-most, profile and a second, in particular downstream, in particular downstream-most, profile, the functional surface of the first profile and the functional surface of the second profile in particular each having at least two different curvatures in the circumferential direction in at least one radial plane relative to the axis of rotation of the turbomachine in at least one temperature range below a defined operating temperature.

This enables particularly stable mounting of the stator vane segment in the turbomachine.

In an embodiment of the present invention, the two profiles are disposed at axially opposite end portions and/or ends of a shroud, in particular of a common shroud, in particular of the outer shroud, and each extend in particular in the circumferential direction at least partially over a circumferential length of the stator vane segment, in particular along the associated shroud of the stator vane segment, and each in particular have at least one functional surface which extends at least in the axial direction and at least partially, preferably entirely, over the circumferential length of the stator vane segment in the circumferential direction.

This makes it possible to improve the mounting of the stator vane segment in the turbomachine.

In an embodiment of the present invention, at least one profile disposed on the shroud is at least partially configured as a hook profile over its length in the circumferential direction, preferably entirely over the full circumferential length of the stator vane segment.

This enables the stator vane segment to be readily mounted in the turbomachine in a particularly stable manner.

In an embodiment of the present invention, the first profile and/or the second profile have/has at least one projection extending at least partially in the axial direction and in the circumferential direction and (each) having a radially inwardly facing inner surface and a radially outwardly facing outer surface, where, in the case of the first, upstream profile, in particular the inner surface of the projection at least partially forms the functional surface, and in the case of the second, downstream profile, in particular the outer surface of the projection (respectively).

This makes it possible to achieve improved support, and in particular so when a tilting moment about an axis perpendicular to the axis of rotation is caused by the occurring flow forces, and in particular to provide full contact of the functional surface on the turbomachine casing. Thus, it is possible in particular to prevent at least one functional surface from being lifted by the tilting moment from an associated contact surface of the turbomachine casing. The tilting moment may in particular rather be used to increase the contact pressure of the stator vane segment against an associated contact surface of the turbomachine casing, in particular in the region of at least one functional surface of the stator vane segment.

In an embodiment of the present invention, the first profile and/or the second profile, in particular each, have/has a profile cross section having a first radially inner projection which extends at least partially in the axial direction and in the circumferential direction and a second, radially more outward projection which also extends at least partially in the axial direction and in the circumferential direction, and further having a web extending at least partially in the radial direction therebetween, in particular (each) have/has an at least partially U-shaped profile cross section, where, in particular in the case of the first profile, the inner surface of the second, radially more outward projection at least partially forms the functional surface and/or in the case of the second profile, in particular the outer surface of the second, more outward projection (respectively).

This enables particularly easy attachment of the stator vane segment to the turbomachine casing.

In an embodiment of the present invention, at least one functional surface of at least one profile has a first functional surface section and at least one further functional surface section, in particular at least two further functional surface sections, the first functional surface section being curved with a first, in particular constant, curvature in the circumferential direction in at least one radial plane perpendicular to the axis of rotation of the turbomachine in at least one temperature range below the defined operating temperature of the turbomachine, and at least one further functional surface section, in particular at least two further functional surface sections, being curved with a further, in particular constant, curvature different from the first curvature in the circumferential direction in at least one radial plane relative to the axis of rotation of the turbomachine in at least one temperature range below the defined operating temperature of the turbomachine.

This makes it possible to simplify the manufacture of a stator vane segment according to the present invention. In particular, the two different curvatures of a functional surface in the circumferential direction may be easily incorporated in succession.

In particular, the curvature of the functional surface, in particular in the first functional surface section, in the circumferential direction is defined by a first circle of curvature and/or a first cylinder of curvature extending in the axial direction; i.e., parallel to the axis of rotation of the turbomachine, and in particular in the second functional surface section by a further circle of curvature or curvature cylinder.

Thus, in an embodiment of the present invention, at least one functional surface of at least one profile extends in the first functional surface section in the circumferential direction in particular along a circular path segment defined by a first circle of curvature or by a first cylinder of curvature and in the second functional surface section in the circumferential direction in particular along a circular path segment defined by a second circle of curvature or a second cylinder of curvature.

In an embodiment of the present invention, the first functional surface section is in particular directly adjacent to at least one of the further functional surface sections in the circumferential direction, the first functional surface section merging in the circumferential direction in particular tangentially into the further functional surface section adjacent the first functional surface section in at least one radial plane relative to the axis of rotation of the turbomachine.

This makes it possible to prevent irregularities in the shape of the functional surface, in particular in the circumferential direction. Such irregularities negatively affect the strength of the stator vane segment and, in addition, are detrimental with respect to the sealing against the turbomachine casing, inter alia because of the occurrence of stress peaks.

In an embodiment of the present invention, in particular at least one functional surface section of at least one functional surface of at least one profile has a constant curvature in the circumferential direction at least over part of its circumferential length, in particular over its entire circumferential length.

In an embodiment of the present invention, at least one functional surface of at least one profile has three functional surface sections, in particular a first functional surface section, a first further functional surface section, and a second further functional surface section, the first functional surface section being disposed in particular between the two further functional surface sections in the circumferential direction.

If the functional surface of at least one profile has only a first functional surface section and only one further functional surface section; i.e., only two functional surface sections, at least one of the functional surface sections extends in particular over one-half of the functional surface in the circumferential direction; in particular, both functional surface sections each extend over a respective one-half of the functional surface in the circumferential direction.

In an embodiment of the present invention, in particular in the case of a functional surface having two or three functional surface sections in the circumferential direction, at least one of the functional surface sections extends over a portion of at least 20%, at least 30%, at least 40% or at least 50% and no more than 50%, 60%, 70% or 80% of the circumferential length of the associated functional surface.

In an embodiment of the present invention, in particular in the case of a functional surface having three functional surface sections in the circumferential direction, in particular at least one of the functional surface sections extends approximately 33%, in particular 33%, over the circumferential length of the functional surface.

In an embodiment of the present invention, the curvature of the functional surface of the first functional surface section is defined in the circumferential direction at least over part of the circumferential length, in particular over the entire circumferential length, of the first functional surface section by a first circle of curvature lying in a radial plane relative to the axis of rotation of the turbomachine and having a first radius of curvature, the center of the first circle of curvature lying in particular on the axis of rotation of the turbomachine.

Thus, in an embodiment of the present invention, the center of curvature of the first circle of curvature defining the curvature of the first functional surface section coincides in particular with the axis of rotation of the turbomachine; i.e., with the (main) machine axis. In the first functional surface section, the curvature of the functional surface is in particular constant; i.e., defined by the same circle of curvature, over the circumferential length of the first functional surface section, the shape of the functional surface of the first functional surface section being defined in particular by a circular segment of the first circle of curvature in the associated radial plane.

In an embodiment of the present invention, the curvature of the functional surface of at least one further functional surface section is defined in the circumferential direction at least over part of the circumferential length, in particular over the entire circumferential length, of the further functional surface section by a further circle of curvature lying in a radial plane relative to the axis of rotation of the turbomachine and having a further radius of curvature, the center of the further circle of curvature in particular being offset from the axis of rotation of the turbomachine.

In an embodiment of the present invention, the center of the further circle of curvature lies in particular in a common radial plane with the center of the first circle of curvature, which defines the curvature of the first functional surface section.

The radius of the second circle of curvature may be different from the radius of the first circle of curvature, or, unless the center of the second circle of curvature coincides with the center of the first circle of curvature, may be equal to the radius of the first circle of curvature.

In an embodiment of the present invention, the second circle of curvature, which defines the curvature of the second functional surface section, is in particular the same over the entire circumferential length of the second functional surface section and, in particular, the shape of the functional surface in the second functional surface section is defined by a circular segment of the second circle of curvature in the associated radial plane.

In an alternative embodiment of the present invention, the center of the first circle of curvature is offset from the axis of rotation and, in particular, the center of at least one further circle of curvature coincides with the axis of rotation.

In another alternative embodiment of the present invention, all centers of the first circle of curvature and the further circles of curvature defining the curvature of at least one functional surface are offset from the axis of rotation and, in particular, at least two centers of circles of curvature are offset from each other and/or at least two circles of curvature have two different radii of curvature.

In an embodiment of the present invention, at least one further radius of curvature of at least one further circle of curvature is smaller, in particular at least 2%, 3%, or 5% and no more than 5%, 7.5% or 10% smaller, than the first radius of curvature of the first circle of curvature. This means, in particular, that the radius of at least one further circle of curvature is no more than 98%, 97% or 95% and at least 95%, 92.5% or 90% of the radius of the first circle of curvature.

Provided that the respective radii of curvature and the positions of the centers of curvature are suitably selected, this makes it possible to achieve in a relatively simple manner that when the stator vane segment heats during operation of the turbomachine, the associated functional surface deforms in such a way that, at least at the defined operating temperature, a constant curvature of the functional surface is obtained in the circumferential direction, in particular over the entire circumferential length of the functional surface.

This makes it possible, in particular, to compensate, in particular selectively, for a "widening;" i.e., a reduction of the curvature of the functional surface in the circumferential direction, in particular of the outer functional surface sections.

In an embodiment of the present invention, the functional surface is symmetrically curved in the circumferential direction in at least one radial plane relative to the axis of rotation of the turbomachine, as considered along the circumferential length of the functional surface of the stator vane segment, in particular symmetrically with a deviation of up to ±10% with respect to the position of the axis of symmetry relative to a center of the functional surface in the circumferential direction and/or with respect to the shape of the functional surface with a deviation of up to ±10% from the associated radius of curvature.

In an embodiment of the present invention, the at least two different curvatures of at least one functional surface of at least one profile of the stator vane segment are selected such that when the stator vane segment is in an installed operative condition in a turbomachine, the functional surfaces have a constant curvature in the circumferential direction at least at the defined operating temperature during operation of the turbomachine, which constant curvature is in particular defined by a circle of curvature lying in a radial plane relative to the axis of rotation of the turbomachine and having a radius of curvature whose center lies on the axis of rotation of the turbomachine.

This makes it possible to ensure full contact of the functional surface of the stator vane segment with the turbomachine casing in the circumferential direction, at least at the defined operating temperature.

In an embodiment of the present invention, a stator vane array for a, in particular of a, turbomachine, in particular for a, in particular of a, gas turbine, in particular for a, in particular of a, turbine stage of a gas turbine, has one or more stator vane segments according to any of the embodiments described herein.

In an embodiment of the present invention, a turbomachine, in particular a gas turbine, in particular at least one turbine stage of the gas turbine, has at least one stator vane segment according to any of the embodiments described herein.

In order to manufacture a stator vane segment according to any of the embodiments described herein, in an embodiment, first the stator vane segment is manufactured by primary shaping, in particular by casting or using an additive process, and subsequently machined. During machining, at least one functional surface of at least one profile is machined in particular at least by machining with a geometrically undefined cutting edge, particularly by grinding, to incorporate the at least two different curvatures of the functional surface in the circumferential direction. In this process, in particular in a first step, the first curvature is incorporated into the functional surface over its entire length in the circumferential direction and, in particular in at least one further step, the further curvature is incorporated into the respective at least one further functional surface section. Accordingly, in an embodiment, at least one of the functional surfaces is machined, in particular the different curvatures thereof are produced, by machining with a geometrically undefined cutting edge, particularly by grinding.

In an embodiment, in the process of incorporating the first curvature into at least one functional surface, the center of a rotationally symmetric cutting tool, in particular the center of a rotationally symmetric grinding tool, coincides with the center of the first circle of curvature and in particular defines a first center of grinding.

In an embodiment, in the process of incorporating a further curvature into the functional surface, the center of a rotationally symmetric cutting tool, in particular the center of a rotationally symmetric grinding tool, coincides with the center of the associated further circle of curvature and defines a further center of grinding, the further center of grinding in particular being offset from the first center of grinding.

This makes it possible to readily incorporate two different curvatures into the functional surface.

In an embodiment of the present invention, the stator vane segment is made from a nickel-based alloy, in particular a nickel-based superalloy, or a cobalt-based superalloy, or includes a nickel-based alloy, a nickel-based superalloy or a cobalt-based superalloy.

BRIEF DESCRIPTION OF THE DRAWINGS

Other advantageous embodiments of the present invention will be apparent from the dependent claims and the following description of preferred embodiments and the associated figures, in which like reference numerals denote functionally equivalent parts and/or sections. To this end, the drawing shows, partly in schematic form, in:

FIG. 3 a schematic cross-sectional view depicting the portion of the stator vane segment of FIGS. 2*a* and 2*b* attached to a turbomachine casing;

FIG. 4 a first perspective view of the outer shroud of the stator vane segment of FIGS. 2*a* and 2*b* and 3;

DETAILED DESCRIPTION

Figure 1:
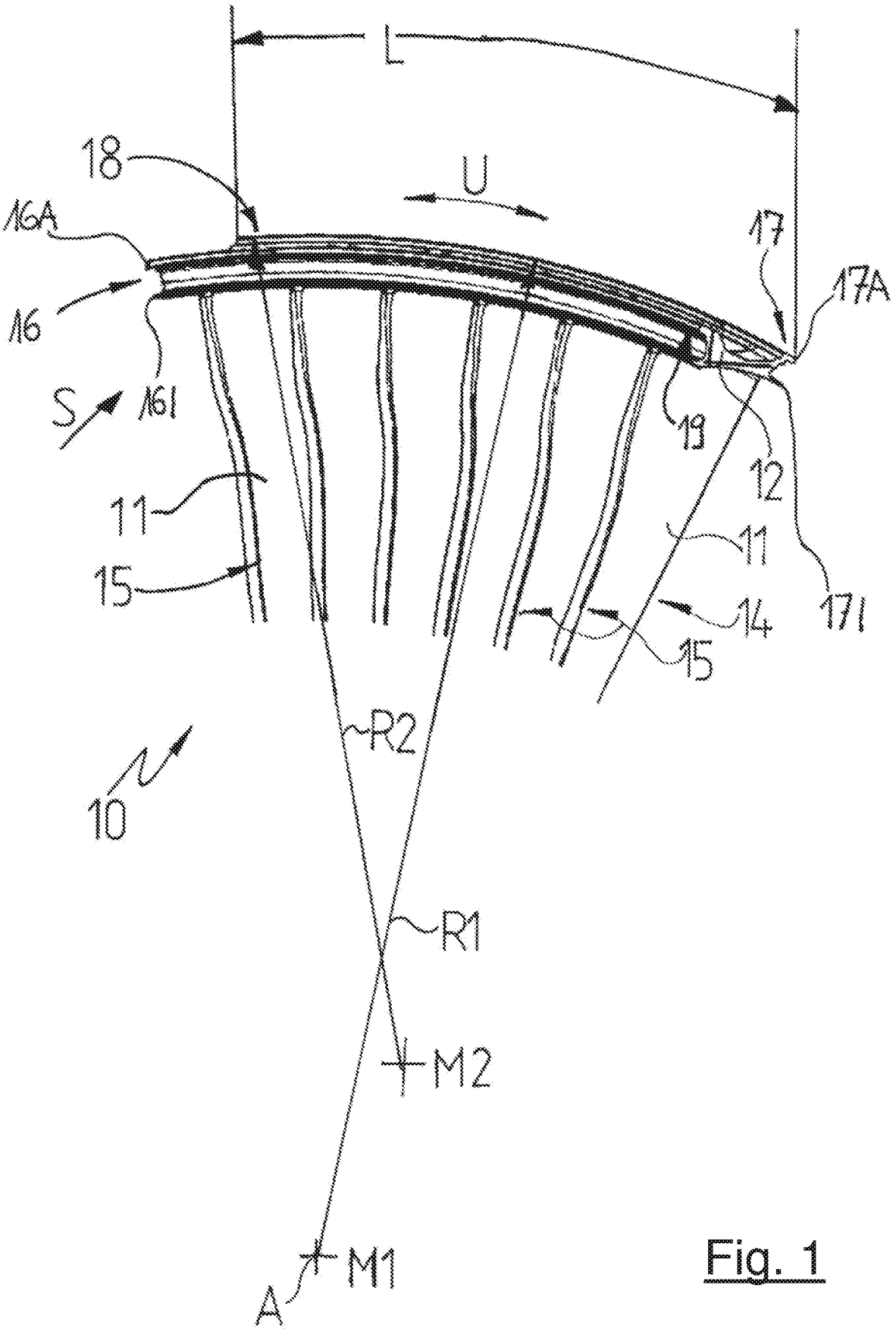
FIG. 1 a perspective view of a portion of a stator vane segment according to a first embodiment of the present invention at an operating temperature below a defined operating temperature.

FIG. 1 shows, in perspective view, a portion of a stator vane segment according to a first embodiment of the present invention at an operating temperature below a defined operating temperature.

This stator vane segment 10 includes six stator vanes 11 which are interconnected by an outer shroud 12 which is disposed further outward, as viewed in a radial direction relative to an axis of rotation A of an associated turbomachine, and by a radially more inward inner shroud.

Outer shroud 12 has disposed thereon two profiles 16, 17 for attachment of stator vane segment 10 to the turbomachine casing, the profiles each extending in circumferential direction U over the entire circumferential length L of stator vane segment 10, the stator vane segment 10 having a first, upstream profile 16 and a second, downstream profile 17, as considered with respect to flow direction S in which the flow passes through stator vane segment 10 during operation of an associated turbomachine.

The two profiles 16 and 17 are configured as continuous hook profiles 16, 17 of substantially U-shaped cross section.

The two profiles 16 and 17 each have two projections 16I and 16A, respectively 17I and 17A, namely a radially more inward projection 16I, respectively 17I, and a radially more outward projection 16A, respectively 17A, the projections 16I and 16A, respectively 17I and 17A, of the two hook profiles 16, 17 each extending substantially in the axial direction; i.e., substantially parallel to axis of rotation A.

A radially outwardly facing outer surface 18 of outer projection 17A of the second, downstream profile 17 and a radially inwardly facing inner surface 19 of outer projection 16A of the first, upstream profile 16 are each designed as a functional surface 18, respectively 19, the functional surfaces 18 and 19 each extending in circumferential direction U; i.e., along the outer projections 17A and 16A in circumferential direction U, in a radial plane perpendicular to axis of rotation A of the turbomachine, and in the axial direction, in particular parallel to axis of rotation A.

In the condition shown; i.e., at an operating temperature below the defined operating temperature, functional surface 18 has two different curvatures in a radial plane perpendicular to axis of rotation A, in particular over its entire width in the axial direction, the functional surface 18 being defined in at least two points by two different circles of curvature, as symbolized by the two different radii of curvature R1 and R2.

In this embodiment of a stator vane segment 10 according to the present invention, the two circles of curvature defining the curvature of functional surface 18 differ both in the position of their centers M1 and M2 and in their radii R1 and R2, the center M1 of the first circle of curvature having the radius R1 coinciding with axis of rotation A.

Figure 2A:
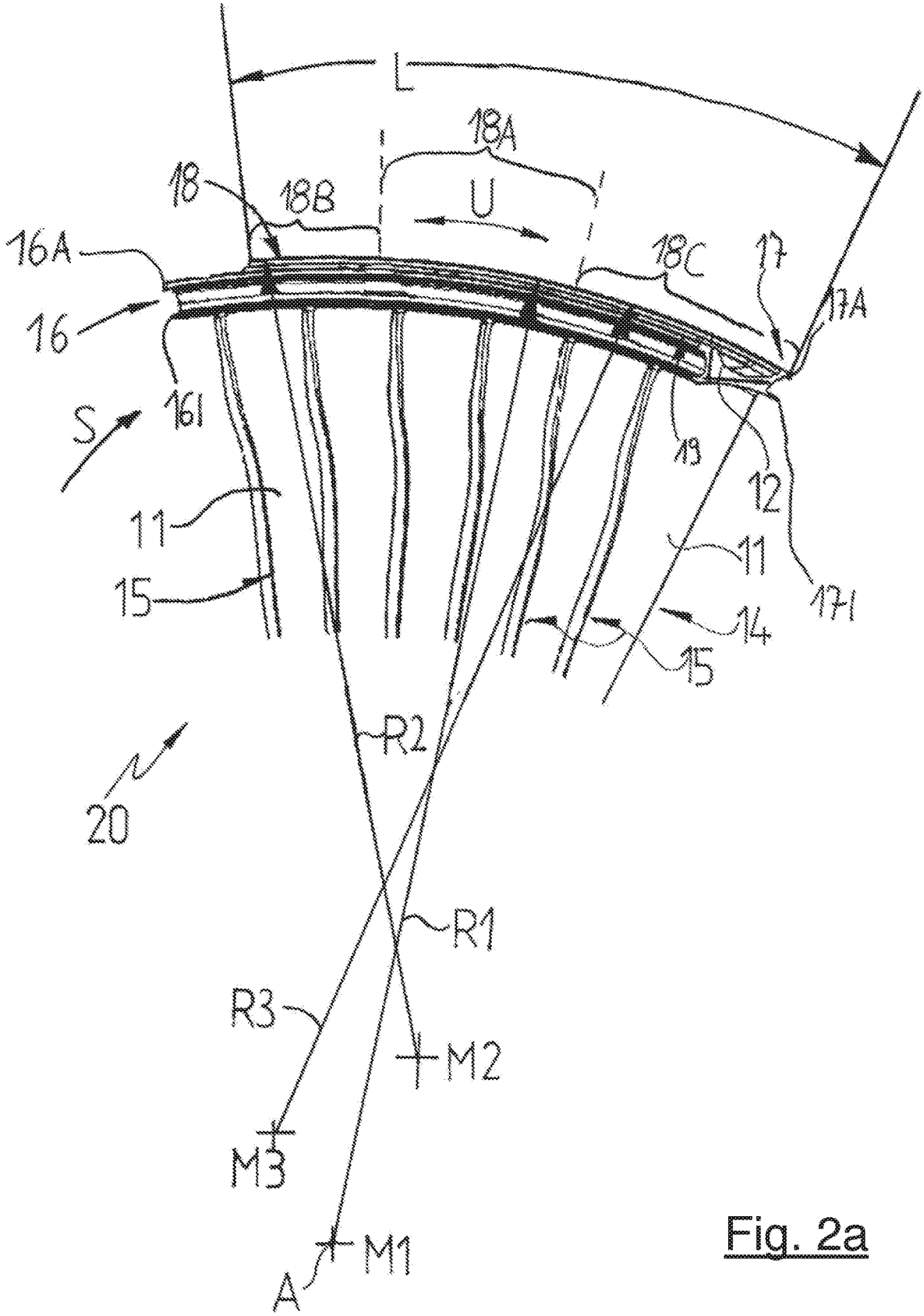
FIG. 2*a* a perspective view of a portion of a stator vane segment according to another embodiment of the present invention at an operating temperature below a defined operating temperature.
Figure 2B:
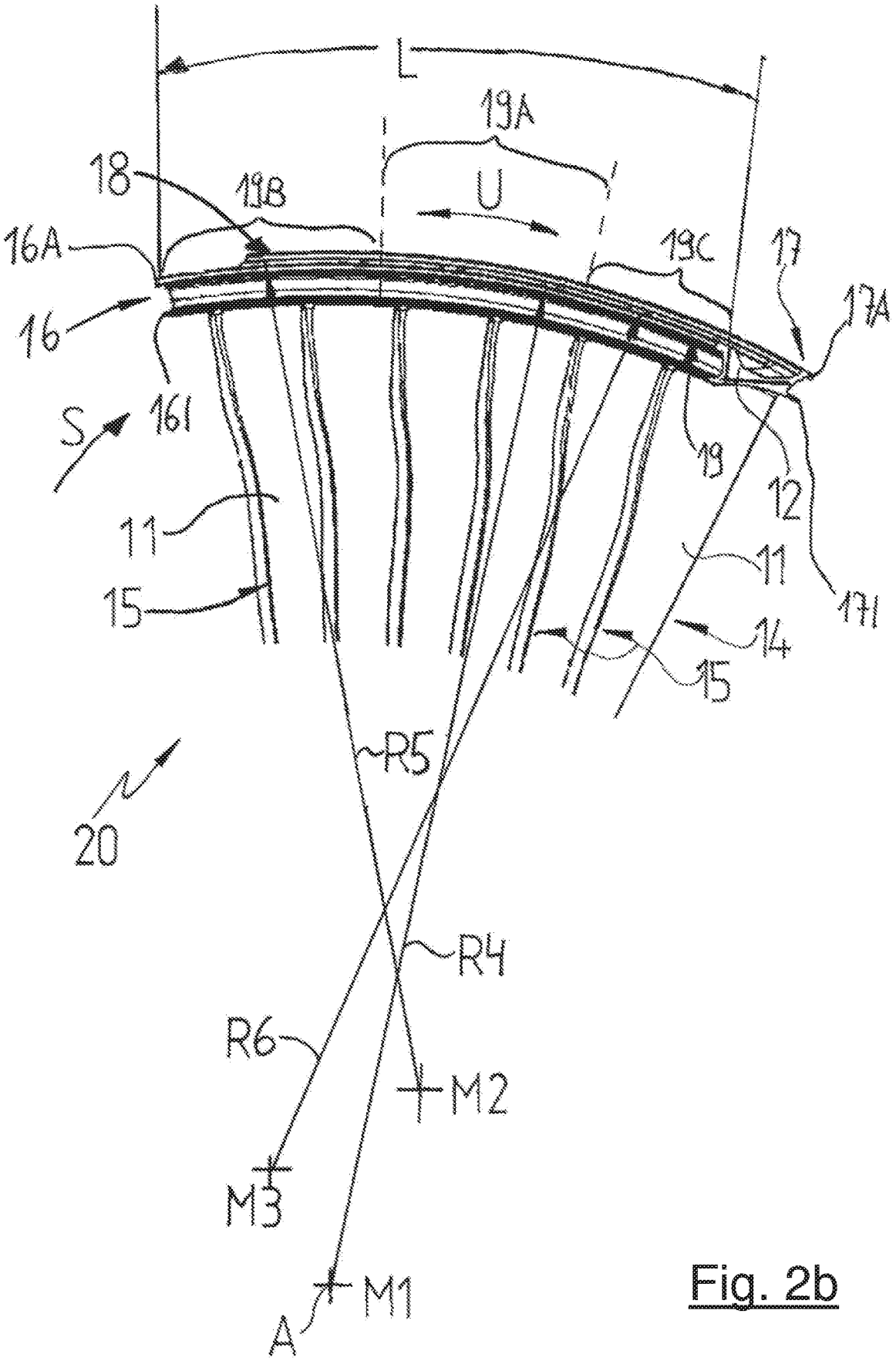
FIG. 2*b* a view showing the portion of the stator vane segment of FIG. 2*a;*

FIGS. 2*a* and 2*b* each show a portion of a stator vane segment 20 according to a second embodiment the present invention. For the sake of clarity, only some of the reference numerals are shown in FIGS. 2*a* and 2*b*, respectively. Stator vane segment 20 differs from the stator vane segment 10 according to a first embodiment of the present invention, shown in FIG. 1, in that both functional surface 18 and function surface 19 have three adjoining and tangentially merging functional surface sections. Functional surface sections 18A, 18B and 18C of functional surface 18 are visibly shown in FIG. 2*a*, and functional surface sections 19A, 19B and 19C of functional surface 19, shown in FIG. 2*b*, have different curvatures.

The two outer functional surface sections 18B, respectively 19B, and 18C, respectively 19C; i.e., the left and right ones in the figure, each extend over a portion of 33% of circumferential length L of the respective profile 17, while the central, first functional surface section 18A, respectively 19A, extends over a portion of 40% of circumferential length L of the respective profile 17, respectively 16, in circumferential direction U.

In this embodiment of a stator vane segment 20 according to the present invention, the individual functional surface sections 18A, 18B and 18C, respectively 19A, 19B and 19C, each have a constant curvature in circumferential direction U.

Thus, in the case of stator vane segment 20, in first functional surface section 18A, respectively 19A, functional surfaces 18 and 19 extend along a circular path segment of a first circle of curvature which is defined by a center of circle M1 and a first radius of curvature R1, respectively R4, while in second functional surface section 18B, respectively 19B, the functional surfaces extend in circumferential direction U along a circular path segment of a second circle of curvature which is defined by a second center of circle of curvature M2 and a second radius of curvature R2, respectively R5. In third functional surface section 18C, respectively 19C, functional surfaces 18 and 19 extend in circumferential direction U along a circular path segment which is defined by a third circle of curvature having a third center of circle of curvature M3 and a third radius of curvature R3, respectively R6.

Center of circle of curvature M1 of the first circle of curvature is selected to coincide with axis of rotation A of the turbomachine, while the two centers of circle of curvature M2 and M3 of the two further circles of curvature are offset from axis of rotation A and, in this case, in particular also offset from each other.

However, in this embodiment of the present invention, centers of curvature M1, M2 and M3 of the circles of curvature defining the curvature of the functional surface lie all in a common radial plane relative to axis of rotation A.

The centers of circle of curvature of a profile 16, respectively 17, may lie in a common radial plane with the centers of circle of curvature of the respective other profile 16, 17 or in a radial plane different therefrom.

In this embodiment, the two radii of circle of curvature R2, respectively R5, and R3, respectively R6, of the two outer functional surface sections 18B and 18C, respectively 19B and 19C, are each selected to be smaller than the radius of circle of curvature R1, respectively R4, defining the curvature of central functional surface section 18A, respectively 19A.

Given suitable selection of the respective radii of curvature R1, R2 and R3, respectively R4, R5 and R6, and of the positions of the centers of curvature M1, M2 and M3 in relation thereto, this makes it possible to achieve in a relatively simple manner that when stator vane segment 20 heats during operation of the turbomachine, the associated functional surface 18, respectively 19, deforms in such a way that, at least at the defined operating temperature, a constant curvature of functional surface 18, respectively 19, is obtained in circumferential direction U, in particular over the entire circumferential length L of functional surface 18, respectively 19. This makes it possible, in particular, to compensate, in particular selectively, for a "widening;" i.e., a reduction of the curvature of functional surface 18, respectively 19, in the circumferential direction, in particular of the outer functional surface sections 18B and 18C, respectively 19B and 19C.

In the axial direction, functional surfaces 18, 19 are not curved; i.e., in the axial direction, functional surfaces 18, 19 extend along a straight line.

The individual adjoining functional surface sections 18A, 18B and 18C, respectively 19A, 19B and 19C, are in each case directly adjacent to each other and merge tangentially into one another.

FIG. 3 shows, in schematic cross-sectional view, a portion of the stator vane segment of FIGS. 2*a* and 2*b* attached to a turbomachine casing. This view shows particularly well the manner in which stator vane segment 20 is supported against turbomachine casing 30 by the two profiles 17 and 16, namely by the outer projections 16A and 17A of the two profiles 16 and 17.

In order to prevent stator vane segment 20, in particular its functional surfaces 18 and 19, from lifting from the associated engagement surface or contact surface of the turbomachine casing, in particular as a result of a tilting moment about an axis perpendicular to axis of rotation A, in this case an axis oriented perpendicularly to the plane of the drawing, which tilting moment is caused by fluid passing through stator vane segment 20 in flow direction S, stator vane segment 20 is supported against turbomachine casing 30 by radially outwardly facing functional surface 18 of the second, downstream hook and radially inwardly facing functional surface 19.

With such a design, flow-induced tilting moments lead to an enhanced supporting effect, instead of causing functional surfaces 18, 19 to lift from the associated contact surfaces of casing 30.

This makes it possible, on the one hand, to prevent distribution of forces over a small supporting surface, and especially so in the case of the high forces occurring as a result of the additional tilting moment. This is advantageous for reasons of strength. In addition, it is possible to prevent leakages caused by lifting of functional surface(s) 18, 19 the associated contact or engagement surface(s). This is advantageous especially with regard to the efficiency of the turbomachine.

FIG. 4 shows shroud 12 of stator vane segment 20 of FIG. 3 in a perspective view which, in particular, shows particularly well the manner in which functional surface 18 of second, downstream profile 17 extends both in circumferential direction U along profile 17 and in the axial direction, in particular linearly without a curvature.

This applies similarly to functional surface 19 of the forward, upstream profile 16, functional surface 19 also extending in the axial direction and in circumferential direction U over the length of profile 16 and also not having a curvature in the axial direction.

Figure 5:
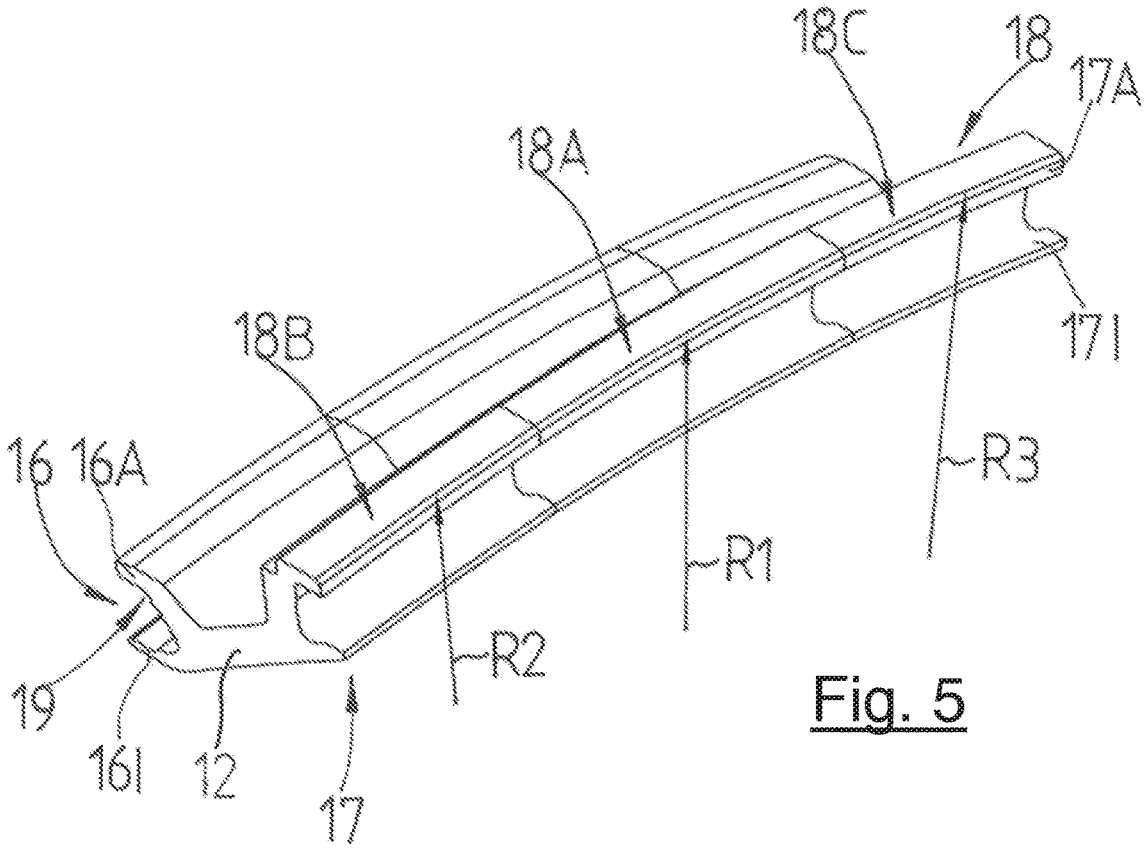
FIG. 5 a second perspective view depicting the outer shroud of the stator vane segment of FIGS. 2*a* through 4.

The individual functional surface sections 18A, 18B and 18C of functional surface 18 of second, downstream profile 17, as well as their extent in circumferential direction U over the entire circumferential length L of profile 17 and also their extent in the axial direction are readily discernible in FIG. 5.

Figure 6:
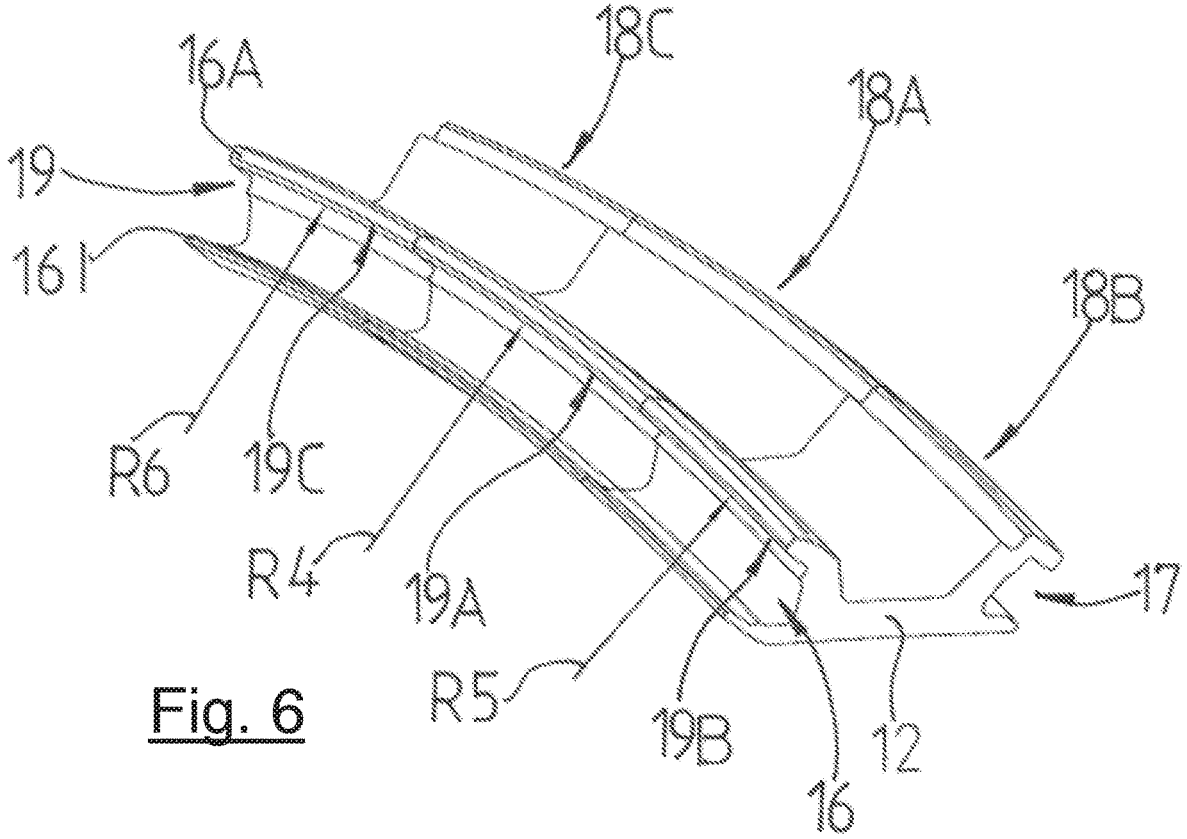
FIG. 6 a third perspective view depicting the outer shroud of FIGS. 2*a* through 5.

As can be seen from FIG. 6, radially inwardly facing functional surface 19, which is formed by the inner surface of outer projection 16A of forward, upstream profile 16, also has three functional surface sections 19A, 19B and 19C, which are also directly adjacent to each other and also merge tangentially into one another and are each defined by a respective circle of curvature and each have a constant curvature in circumferential direction U.

First functional surface section 19A of functional surface 19 is defined by a first circle of curvature having a first radius of curvature R4, the center of curvature of the respective circle of curvature in particular also coinciding with axis of rotation A.

Second functional surface section 19B also has a constant curvature in circumferential direction U over the length of functional surface section 19B, the curvature of second functional surface section 19B being defined by a second circle of curvature having a second radius of curvature F5 whose center is offset from axis of rotation A, but which lies in particular in a common radial plane with the center of the first circle of curvature.

Third functional surface section 19C also has a constant curvature in circumferential direction U over the length of functional surface section 19C, the curvature of third functional surface section 19C being defined by a third circle of curvature having a third center of circle of curvature and a third radius of curvature R6, the third center of circle of curvature also being offset from axis of rotation A, but in particular also lying in a common radial plane with the first center of circle of curvature and the second center of curvature.

As in the case of functional surface 18, radius R5 of the second circle of curvature and radius R6 of the third circle of curvature are in particular each smaller than radius R4 of the first circle of curvature. Moreover, the radius of the second circle of curvature R5 and the radius of the third circle of curvature R6 are different.

Figure 7:
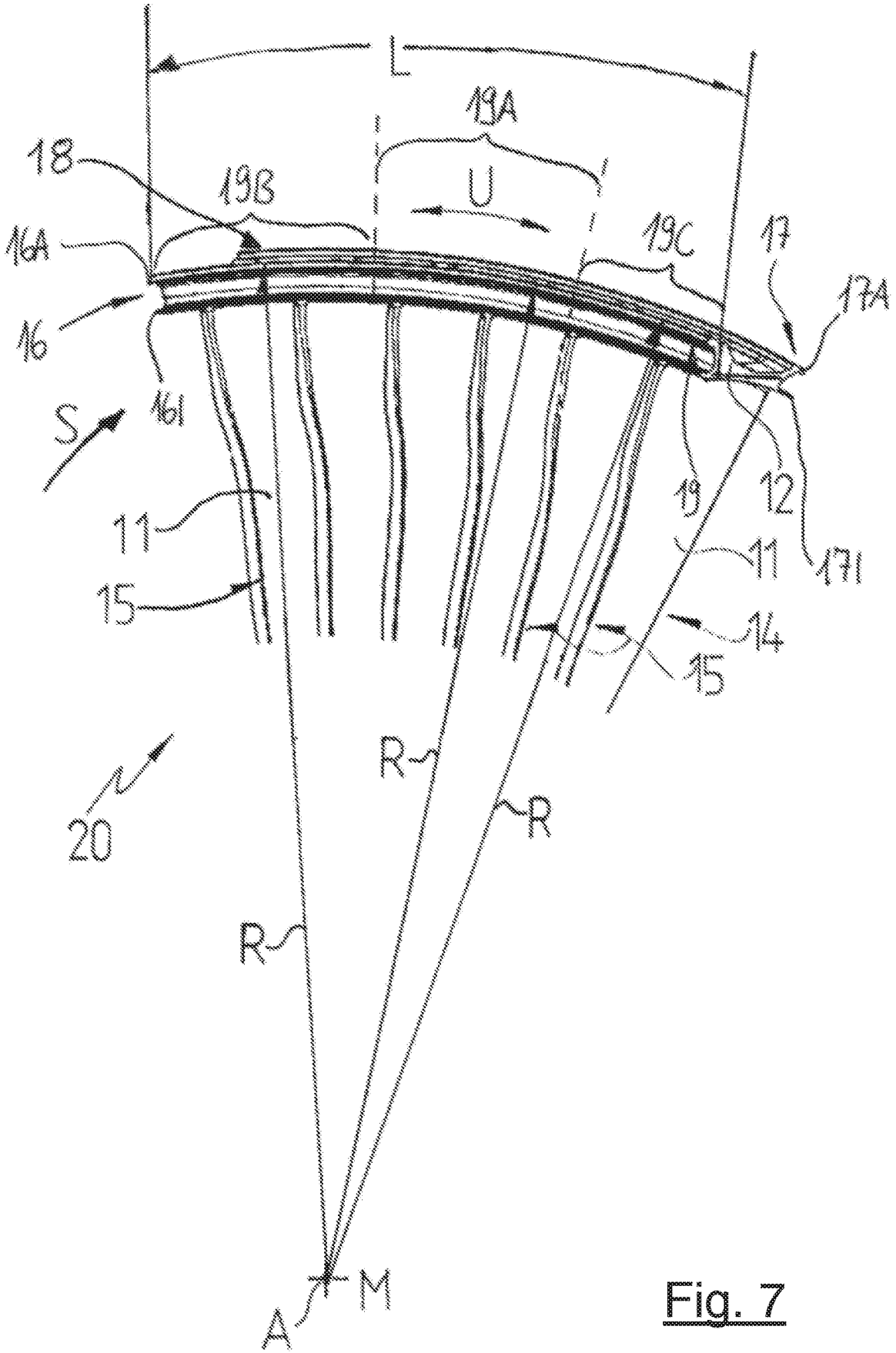
FIG. 7 a view showing the portion of the stator vane segment of FIGS. 2*a* and 2*b* at the defined operating temperature.

FIG. 7 shows stator vane segment 20 of FIGS. 2*a* and 2*b* at the defined operating temperature. For the sake of clarity, only the individual functional surface sections 19A, 19B and 19C of functional surface 19 are denoted by reference numerals. As a result of heating during the operation of the turbomachine, stator vane segment 20 shown in FIG. 7 has been deformed, in particular "widened" compared to the condition below the defined operating temperature, which is shown in FIGS. 2*a* and 2*b*. In particular, the curvature of each of functional surfaces 18 and 19 has decreased, in particular in the two outer functional surface sections 19B and 19C, respectively 18B and 18C.

In the illustrated condition at the defined operating temperature, the two functional surfaces 18 and 19 of stator vane segment 20 each have a constant curvature in circumferential direction U over the entire circumferential length L of profiles 16 and 17, instead of two different curvatures, such as below the defined operating temperature, as shown in FIGS. 2*a* and 2*b*. In FIG. 7, this is symbolized by the arrows designated "R," which represent the respective radii R of the associated circles of curvature at the operating temperature.

In a particularly advantageous embodiment of the present invention, provided, in particular, that the individual radii of curvature R1, R2 and R3, respectively R4, R5 and R6, are suitably selected, and that the centers M1, M2 and M3 of the associated circles of curvature are suitably selected, at least as a function of the operation conditions, the geometric shape of stator vane segment 20 and the material of stator vane segment 20, functional surfaces 18 and 19 are curved concentrically about axis of rotation A, at least the defined operating temperature, as in the present case.

Because of the generally greater wall thicknesses of the turbomachine casing, the engagement or contact surfaces of the turbomachine casing deform to a significantly lesser extent during operation, so that their curvature hardly changes in response to heating. Therefore, the engagement or contact surfaces of the turbomachine casing are preferably manufactured with a constant, in particular concentric curvature relative to the axis of rotation.

Thus, with a stator vane segment according to the present invention, it can be achieved or ensured that functional surfaces 18 and 19 make full contact with an associated contact surface of the turbomachine casing, in particular with a contact surface of the turbomachine casing that is curved with a constant curvature, at least at the defined operating temperature.

Although exemplary embodiments have been described in the foregoing, it should be noted that many modifications are possible. It should also be appreciated that the exemplary embodiments are only examples, and are not intended to limit the scope, applicability, or configuration in any way. Rather, the foregoing detailed description provides those skilled in the art with a convenient road map for implementing at least one exemplary embodiment, it being understood that various changes may be made in the function and arrangement of elements described without departing from the scope of protection as is derived from the claims and the combinations of features equivalent thereto.

LIST OF REFERENCE NUMERALS

10, 20 stator vane segment according to the present invention
11 stator vane
12 outer shroud
14 forward, upstream edge of the stator vane (leading edge)
15 aft, downstream edge of the stator vane
16 first, upstream profile
16A radially outer projection of the first profile
16I radially inner projection of the first profile
17 second, downstream profile
17A radially outer projection of the second profile
17I radially inner projection of the second profile
18 functional surface of the second, downstream profile
18A first functional surface section
18B second functional surface section
18C third functional surface section
19 functional surface of the first, upstream profile
19A first functional surface section
19B second functional surface section
19C third functional surface section
30 turbomachine casing
A axis of rotation of the turbomachine, (main) machine axis
L circumferential length
M1 center of the first circle of curvature
M2 center of the second circle of curvature
M3 center of the third circle of curvature
R radius of the circle of curvature at the defined operating temperature
R1, R4 radius of the first circle of curvature
R2, R5 radius of the second circle of curvature
R3, R6 radius of the third circle of curvature
S flow direction
U circumferential direction

What is claimed is:

1. A stator vane segment for a turbomachine comprising:

at least one stator vane; and at least one shroud having a first, upstream profile and a second, downstream profile, the first and second profiles disposed on the shroud and adapted for attachment of the stator vane segment to a turbomachine casing, the first and second profiles each extending in a circumferential direction at least partially over a circumferential length of the stator vane segment along the shroud, the first profile having a first projection with a first functional surface extending at least partially in an axial direction and in the circumferential direction, the first functional surface being a radially inward facing surface;

the second profile having a second projection with a second functional surface extending at least partially in the axial direction and in the circumferential direction, the second functional surface being a radially outward facing surface;

wherein in all temperatures in at least one temperature range below a defined operating temperature of the turbomachine, at least one of the first functional surface and the second functional surface having at least two different curvatures in the circumferential direction in at least one radial plane perpendicular to an axis of rotation of the turbomachine, the at least two different curvatures having centers of curvature offset from each other.

2. The stator vane segment as recited in claim 1 wherein the first projection has a radially outwardly facing outer surface and the second projection has a radially inwardly facing inner surface.

3. The stator vane segment as recited in claim 1 wherein the first profile has a first profile cross section having the first projection, the first projection being a first radially inner projection extending at least partially in the axial direction and in the circumferential direction, the first profile cross section further having and a second, radially more outward projection also extends at least partially in the axial direction and in the circumferential direction and further having a web extending at least partially in the radial direction therebetween; or the second profile has a second profile cross section having a first radially inner projection extending at least partially in the axial direction and in the circumferential direction, the second profile cross section further having the second projection, the second projection being a radially more outward projection also extends at least partially in the axial direction and in the circumferential direction and further having a web extending at least partially in the radial direction therebetween.

4. The stator vane segment as recited in claim 3 wherein the first inner projection, the second outer projection and the web define an at least partially U-shaped profile cross section.

5. The stator vane segment as recited in claim 1 wherein the first or second functional surface has a first functional surface section and at least one further functional surface section, the first functional surface section being curved with a first curvature in the circumferential direction in the at least one radial plane in the at least one temperature range below the defined operating temperature of the turbomachine, the at least one further functional surface section being curved with a further curvature different from the first curvature in the circumferential direction in the at least one radial plane in the at least one temperature range below the defined operating temperature of the turbomachine.

6. The stator vane segment as recited in claim 5 wherein the first functional surface section is directly adjacent to the at least one further functional surface section in the circumferential direction, the first functional surface section merging in the circumferential direction tangentially into the further functional surface section in at least one radial plane relative to the axis of rotation of the turbomachine.

7. The stator vane segment as recited in claim 1 wherein the first or second functional surface has a first functional surface section, a first further functional surface section, and a second further functional surface section, the first functional surface section, the first further functional surface section, and the second further functional surface section each having respectively a first curvature, a second curvature and a third curvature of the different curvatures.

8. The stator vane segment as recited in claim 7 wherein the first functional surface section is disposed in between the first and second further functional surface sections in the circumferential direction.

9. The stator vane segment as recited in claim 5 wherein the curvature of the functional surface of the first functional surface section is defined in the circumferential direction at least over part of the circumferential length of the first functional surface section by a first circle of curvature lying in the radial plane relative to the axis of rotation of the turbomachine and having a first radius of curvature, a center of the first circle of curvature lying on the axis of rotation of the turbomachine.

10. The stator vane segment as recited in claim 5 wherein the first and further curvatures are constant.

11. The stator vane segment as recited in claim 9 wherein the curvature of the functional surface of the at least one further functional surface section is defined in the circumferential direction at least over part of the circumferential length of the further functional surface section by a further circle of curvature lying in the radial plane and having a further radius of curvature, the center of the further circle of curvature offset from the axis of rotation of the turbomachine.

12. The stator vane segment as recited in claim 11 wherein the further radius of curvature is smaller than the first radius of curvature.

13. The stator vane segment as recited in claim 1 wherein the functional surface is symmetrically curved in the circumferential direction in the radial plane, as considered along the circumferential length of the functional surface of the stator vane segment.

14. The stator vane segment as recited in claim 1 wherein the at least two different curvatures are selected such that when the stator vane segment is in an installed operative condition in a turbomachine, the first or second functional surface has a constant curvature in the circumferential direction at least at the defined operating temperature during operation of the turbomachine.

15. The stator vane segment as recited in claim 14 wherein the constant curvature is defined by a circle of curvature lying in the radial plane and having a radius of curvature whose center lies on the axis of rotation of the turbomachine.

16. The stator vane segment as recited in claim 1 wherein the shroud is an outer shroud.

17. A stator vane array comprising a plurality of stator vane segments as recited in claim 1.

18. A turbomachine comprising a turbomachine casing and the stator vane array as recited in claim 17.

19. The turbomachine as recited in claim 18, wherein the turbomachine is a gas turbine.

20. A method for manufacturing the stator vane segment as recited in claim 1, comprising the steps of:

manufacturing the stator vane segment by primary shaping or using an additive process; and machining at least one of the first and second functional surfaces to incorporate the at least two different curvatures of the functional surface in the circumferential direction.

21. The method as recited in claim 20 wherein in a first step, a first curvature of the at least two different curvatures is incorporated into a first functional surface section of the at least one of the first and second functional surfaces over an entire length in the circumferential direction and, in at least one further step, a further curvature of the at least two different curvatures is incorporated into at least one further functional surface section of the at least one of the first and second functional surfaces.

22. The method as recited in claim 20 wherein the manufacturing step includes casting.

23. The method as recited in claim 20 wherein the machining includes grinding.

24. A method for operating a turbomachine with the stator vane segment as recited in claim 1 comprising heating the stator vane segment during operation so the first and second functional surfaces each have a constant curvature in the circumferential direction at the defined operating temperature during operation of the turbomachine.

25. A stator vane segment for a turbomachine comprising:

at least one stator vane; and at least one shroud having at least one first profile disposed on the shroud and adapted for attachment of the stator vane segment to a turbomachine casing, the profile extending in a circumferential direction at least partially over a circumferential length of the stator vane segment along the shroud and having at least one functional surface extending at least partially in an axial direction and in the circumferential direction, wherein in at least one temperature range below a defined operating temperature of the turbomachine, the functional surface of the profile has at least two different curvatures in the circumferential direction in at least one radial plane perpendicular to an axis of rotation of the turbomachine, the at least two different curvatures having centers of curvature offset from each other.

* * * * *